US006163892A

United States Patent [19]

Abbato

[11] Patent Number: 6,163,892

[45] Date of Patent: Dec. 26, 2000

[54] PORTABLE MALE URINAL

[76] Inventor: Tomasine Abbato, 1138 Greenridge La., PGH, Pa. 15220

[21] Appl. No.: 09/449,028

[22] Filed: Nov. 24, 1999

Related U.S. Application Data

[62] Division of application No. 09/053,575, Apr. 2, 1998, Pat. No. 6,021,529.

[51] Int. Cl.[7] ..... A47K 11/12; A61G 9/00

[52] U.S. Cl. ..... 4/144.1; 4/144.3; 4/455

[58] Field of Search ..... 4/144.1, 144.2, 4/144.3, 450–456; 604/247, 323, 326, 335, 350

[56] References Cited

U.S. PATENT DOCUMENTS

| | | | |
|---|---|---|---|
| 703,131 | 6/1902 | Jaenel | 4/144.3 |
| 1,372,101 | 3/1921 | Snow | 604/350 |
| 1,440,765 | 1/1923 | Buckley | 4/144.1 |
| 1,767,240 | 6/1930 | Ivory et al. | 4/144.1 |
| 2,358,850 | 9/1944 | Chenault | 4/144.1 |
| 2,522,273 | 9/1950 | Johnson | 4/144.1 |
| 2,594,339 | 4/1952 | Nugent | 4/144.1 |
| 2,815,511 | 12/1957 | Friedman et al. | 4/144.1 |
| 3,082,434 | 3/1963 | Greene | 4/144.1 |
| 3,452,664 | 7/1969 | Gilbert | 4/455 |
| 3,499,327 | 3/1970 | Lane, Jr. | 4/144.1 X |
| 3,529,599 | 9/1970 | Folkman et al. | 604/323 |
| 3,586,041 | 6/1971 | Monestere | 4/144.1 X |
| 3,703,731 | 11/1972 | Leiser | 4/144.3 |
| 3,750,647 | 8/1973 | Gleason et al. | 4/144.3 X |
| 3,846,849 | 11/1974 | Dooley et al. | 4/450 |
| 3,928,875 | 12/1975 | Persson | 4/451 |
| 4,059,124 | 11/1977 | Hill | 4/144.2 X |
| 4,117,845 | 10/1978 | Brown | 4/144.1 X |
| 4,136,798 | 1/1979 | Oberstein | 4/451 X |
| 4,164,795 | 8/1979 | Johnson | 4/144.1 |
| 4,270,231 | 6/1981 | Zint | 4/144.1 |
| 4,422,188 | 12/1983 | Strutton et al. | 4/144.1 X |
| 4,512,770 | 4/1985 | Cianci et al. | 604/323 |
| 4,559,649 | 12/1985 | Burnett | 4/144.1 |
| 4,827,540 | 5/1989 | Stokes | 4/456 |
| 5,010,599 | 4/1991 | Nilsson | 4/144.3 X |
| 5,290,245 | 3/1994 | Dennis | 251/149.1 |
| 5,331,689 | 7/1994 | Haq | 4/144.1 |
| 5,394,571 | 3/1995 | Vernon | 4/452 |
| 5,406,651 | 4/1995 | Nogay | 4/144.3 |
| 5,592,699 | 1/1997 | Jensen | 4/144.3 |
| 5,727,594 | 3/1998 | Choksi | 604/247 X |
| 5,797,147 | 8/1998 | Young et al. | 4/144.1 |
| 5,842,233 | 12/1998 | Broden | 4/144.1 |

FOREIGN PATENT DOCUMENTS

| | | | |
|---|---|---|---|
| 250768 | 7/1948 | Switzerland | 4/144.1 |
| 106213 | 5/1917 | United Kingdom | 4/144.1 |

*Primary Examiner*—Henry J. Recla
*Assistant Examiner*—Kathleen J. Prunner
*Attorney, Agent, or Firm*—David C. Jenkins; Arnold B. Silverman; Eckert Seamans Cherin & Mellott, LLC

[57] ABSTRACT

A portable male urinal assembly includes a conventional portable male urinal, having a urine receiving reservoir and a spout extending therefrom with an inlet in the spout for receiving the urine, and a urinal attachment having a valve assembly contained therein being secured in fluid communication to the inlet of the spout. The urinal attachment may be secured to the inlet of the spout either by friction fit, snap fit or threads securing the attachment to the inlet. The valve assembly includes a valve element, a hinge pin and a torsion spring for biasing the valve element into position. The urinal attachment may be composed of a bendable resilient material and the reservoir may be composed of a flexible material.

7 Claims, 6 Drawing Sheets

PORTABLE MALE URINAL

This is a division of Application Ser. No. 09/053,575, filed Apr. 2, 1998, now U.S. Pat. No. 6,021,529.

BACKGROUND OF THE INVENTION

1. Field of the Invention

The present invention relates generally to portable male urinals, and more specifically, to a portable male urinal having a valve assembly which permits urine to flow into the urinal, but resists backflow or spillage of the urine following use of the urinal.

2. Description of the Prior Art

Portable male urinals for use by patients confined to bed or people who otherwise have a need for a urinal are well known in the art. Typically, such urinals include a urine receiving reservoir for holding and/or storing urine and a spout extending from the reservoir. The spout includes an inlet through which the urine is received.

A long recognized problem associated with portable male urinals is resisting backflow of the urine following use of the urinal or resisting the undesirable spillage of urine due to, for example, mishandling of the urinal. Backflow or spillage can result in the urine coming into contact with the patient or the bed which in turn can cause unsanitary health conditions and result in the increased risk for further medical problems, such as infections. In addition, the workload of caretakers is increased due to the need for cleaning the patient and/or the bed following the spillage of urine thereon. Mishandling of the urinal may be a result of the bedridden patient leaving the urinal, for example, on the bed following use and then inadvertently contacting the urinal and causing spillage therefrom.

Accordingly, numerous attempts have been made at improving portable male urinals to overcome such problems. For example, U.S. Pat. No. 2,358,850 provides for a male urinal having a tubular trap inserted therein and connected to the urinal container by screw threads so as to minimize leakage of liquid from the container. The tubular trap must be removed before use and then reinserted following each use. In addition, U.S. Pat. Nos. 703,131 and 4,164,795 both provide a rotating nozzle arrangement for an inlet tube which is inserted into a urine container or collector. In both patents, rotation of the nozzle elements aid resisting undesired discharge of the contents of the container or collector. As can be appreciated, the urinals disclosed in these patents require manual operation of the described closing means in order to effectively resist backflow or spillage of urine. Backflow or spillage can occur when attempting to replace the closing means into the urinal closing position, or if the closing means is inadvertently, or otherwise, not replaced following use of the urinal.

In a different type of arrangement, U.S. Pat. No. 5,592,699 discloses a device for use in association with a urinal. The device includes a non-return valve so as to insure that urine can only pass from the funnel area of the device into the urinal, but not back into the funnel area. The funnel area of the device is configured so as to most conveniently be used in relation with a female urinal and not with a portable male urinal.

U.S. Pat. No. 3,499,327 discloses an upright, vertical urine collection apparatus employing a pivoted valve member for diverting a stream of urine entering the collection apparatus. The value member operates by the force and weight of the incoming stream of urine and acts to divert a first portion of the urine sample into a first receptacle while diverting a second portion into a second receptacle. This collection apparatus is not convenient for portable use, such as by a bedridden patent, and is not well suited for resisting spillage of urine contained in the collection apparatus.

Despite the various types of known portable male urinals and other urine collection devices, there remains a need for an improved portable male urinal that may be conveniently used by a patient that is confined to bed or otherwise must use a urinal. Such a portable male urinal would effectively resist backflow and undesirable spillage of urine from the urinal onto the patient or the patient's bed or both.

SUMMARY OF THE INVENTION

The present invention has met the above-identified need. Specifically, the present invention provides for a portable male urinal that will resist undesirable backflow and spillage of urine following use of the urinal by a patient confined to bed.

In a preferred embodiment, a portable male urinal includes a urine receiving reservoir for receiving and storing the urine. The reservoir includes a spout extending therefrom with the spout having an inlet for receiving the urine from a male. Preferably, the spout extends upwardly at an incline from the reservoir to facilitate gravitational flow of urine into the reservoir. In addition, valve means are provided within the spout for permitting flow of urine into the reservoir. The valve means operates so as to resist the backflow of urine and any undesirable spillage from the urinal following use thereof. The valve means may be positioned adjacent the spout inlet or, within the spout at a predetermined distance along the length of the spout. The valve means may include, for example, a valve element and spring biasing means for maintaining the valve element in an open or closed position during periods of use and non-use, respectively. Alternatively, the valve means may include a check valve assembly. As a further alternative, the valve means may include a support member secured to the spout along with a flexible leaf member partially attached to the support member.

Preferably, the reservoir and the spout extending therefrom are formed from a resinous plastic material. The use of a resinous plastic material to form the reservoir and spout allow for the urinal to be produced at a low cost in the case of a disposable urinal. In addition, the resinous plastic material is preferably transparent to allow visual inspection of the quantity, clarity and color of the urine contained in the reservoir. The reservoir may further include drain means in communication therewith for emptying the urinal or withdrawing a urine specimen from the urinal. Handle means may also be provided on the reservoir to aid in the handling and transporting of the urinal.

In another embodiment, the spout is formed from a bendable resilient material to allow the spout to be positioned at various angles. Advantageously, this enables the urinal of the present invention to be used more easily by a patient confined to bed.

In a further embodiment, a portable male urinal assembly includes a urinal attachment for attaching to a conventional portable male urinal. The urinal attachment may include a first end having an opening for receiving the urine and a second end adapted to be secured to the spout of the urinal. Similar to the preferred embodiment as described herein, valve means are contained within the urinal attachment for permitting flow of the urine into the reservoir, but resisting backflow and undesirable spillage following use of the urinal. The second end of the urinal attachment may be secured to the spout either by friction fit, snap fit or by threading the attachment to the spout or other suitable means.

It is an object of the present invention to provide a portable male urinal which may easily be used by a patient confined to bed.

It is a further object of the present invention to provide a portable male urinal that resists backflow and undesirable spillage of urine onto the patient or the patient's bed following use of the urinal.

It is a further object of the present invention to provide a portable male urinal having a valve assembly which permits urine to flow into the urinal, but resists backflow or spillage of urine following use of the urinal.

It is another object of the present invention to provide a urinal attachment which may be easily attached to a conventional portable male urinal, wherein the urinal attachment includes a valve assembly which permits urine to flow into the urinal, but resists backflow or spillage of urine following use of the urinal.

These and other objects of the invention will be more fully understood from the following description of the invention with reference to the drawings appended hereto.

DESCRIPTION OF THE PREFERRED EMBODIMENT

Figure 1:
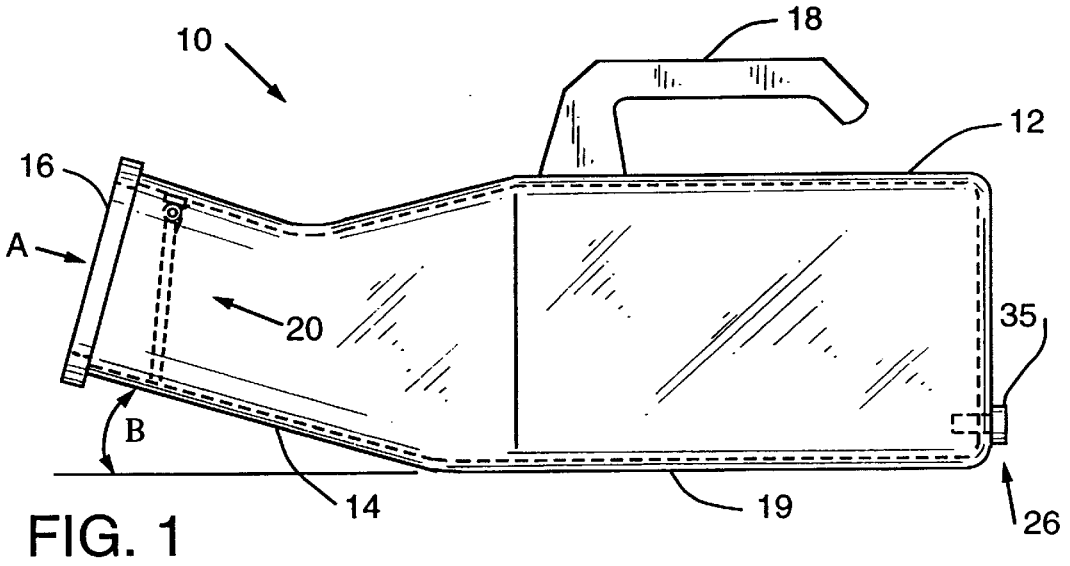
FIG. 1 is a front elevational view showing a preferred embodiment of the portable male urinal of the present invention.
Figure 1A:
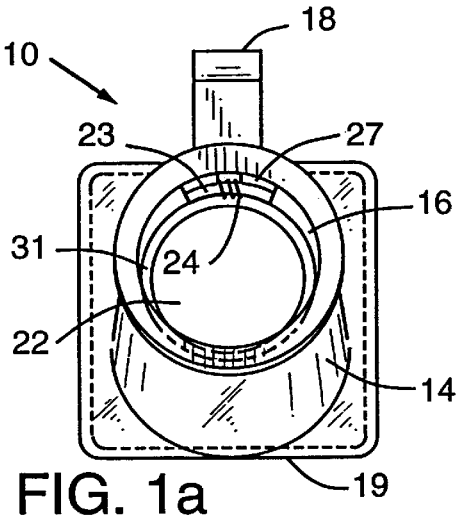
FIG. 1*a* is a left elevational view of the portable male urinal shown in FIG. 1.
Figure 1B:
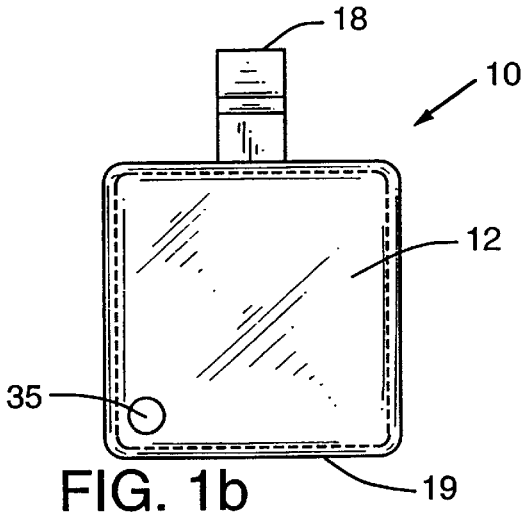
FIG. 1*b* is a right elevational view of the portable male urinal shown in FIG. 1.
Figure 1C:
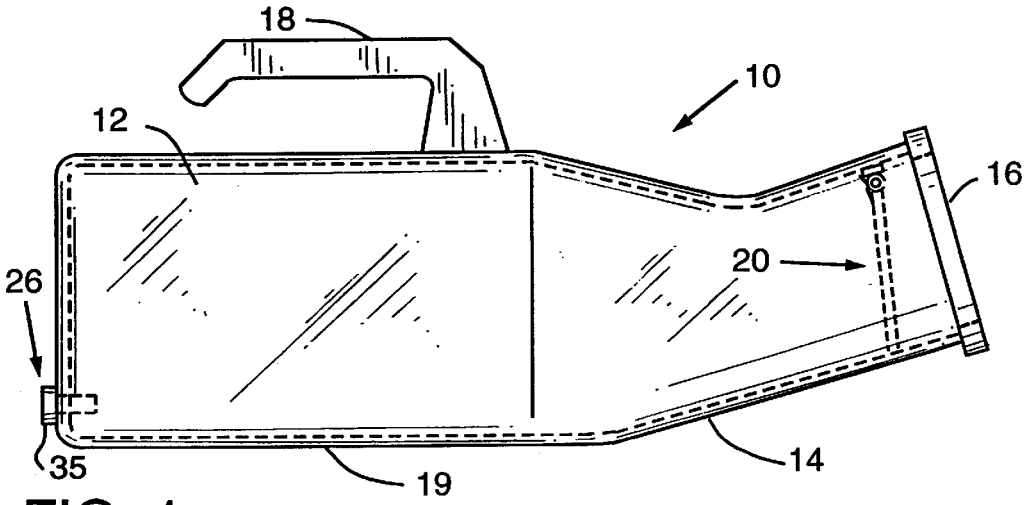
FIG. 1*c* is a rear elevational view of the portable male urinal shown in FIG. 1.
Figure 1D:
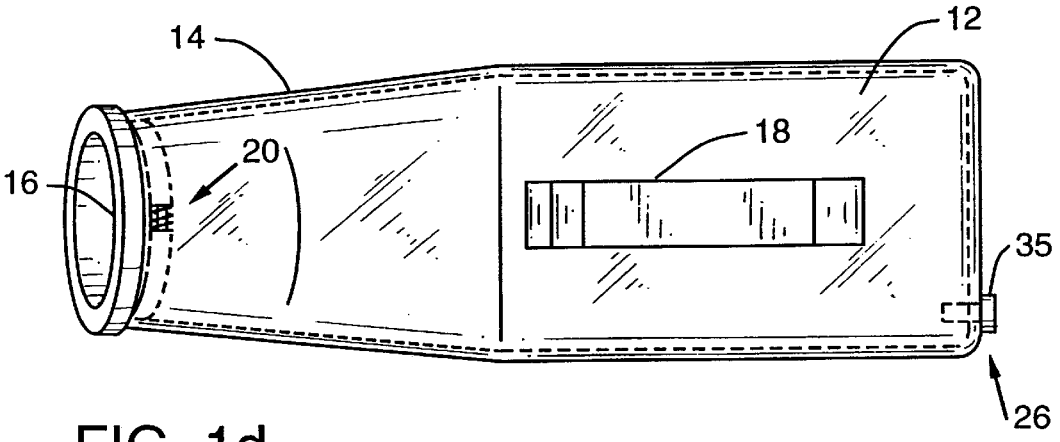
FIG. 1*d* is a top plan view of the portable male urinal shown in FIG. 1.
Figure 1E:
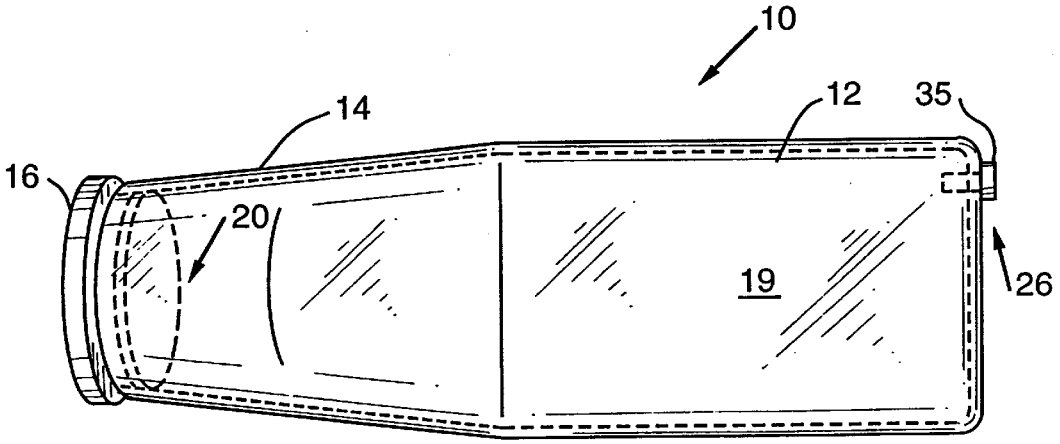
FIG. 1*e* is a bottom plan view of the portable male urinal shown in FIG. 1.

With reference to FIGS. 1–1*e*, there is shown a preferred embodiment of the portable male urinal 10 of the present invention. The urinal 10 may include a urine receiving reservoir 12 for receiving and storing urine and a spout 14 extending therefrom where the spout 14 includes an inlet 16 for receiving the urine in the direction indicated by arrow A. The spout 14 preferably extends upwardly at an incline from the reservoir 12 as illustrated by arrow B, in order to provide for gravitational flow of the urine from the inlet 16 of the spout 14 into the reservoir 12. In addition, a handle 18 may be attached to the urinal 10 in order to hold the urinal 10 during use or for transporting the urinal 10 following use. The urinal 10 preferably has a flat bottom 19 for sitting the urinal 10 in an upright position, as shown in FIG. 1, such as on a table or a bed.

In accordance with an important aspect of the present invention, a valve assembly 20 is provided within the spout 14. The valve assembly 20 allows for urine to flow into the reservoir 12 while resisting backflow or spillage of the urine contained within the reservoir 12 following use of the urinal 10. The valve assembly 20 also resists the undesirable spillage of urine due to, for example, mishandling of the urinal 10. Mishandling of the urinal 10 may be a result of the bedridden patient leaving the urinal 10, for example, on the bed following use and then inadvertently contacting the urinal 10 and causing spillage therefrom. Advantageously, this resists undesirable spillage of urine onto the patient, the patient's bed or health care worker which could result in unsanitary health conditions and the increased risk for further medical problems, such as infections.

Figure 2:
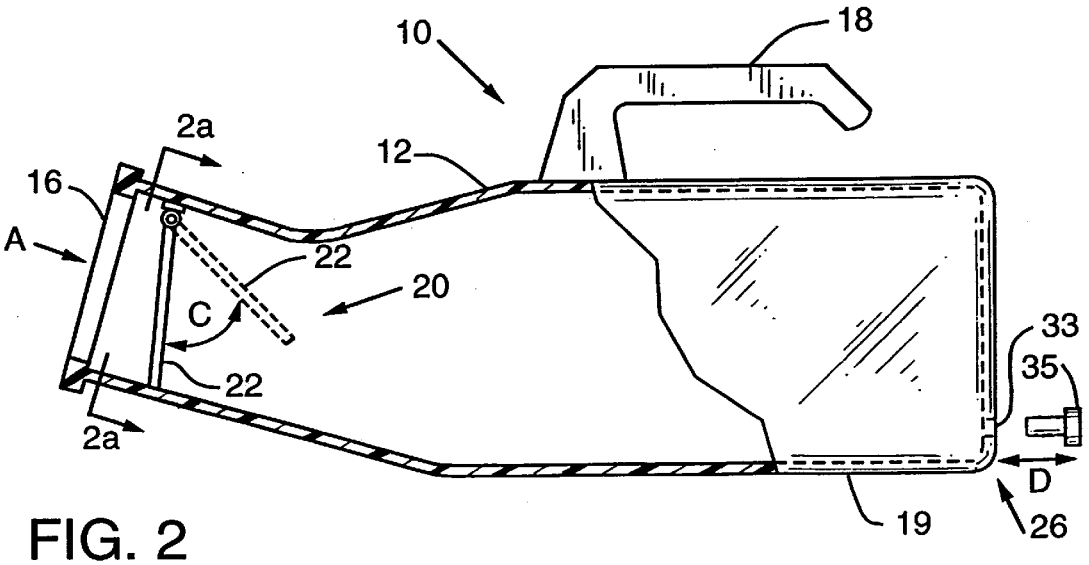
FIG. 2 is a partial sectional view of the portable male urinal of FIG. 1.
Figure 2A:
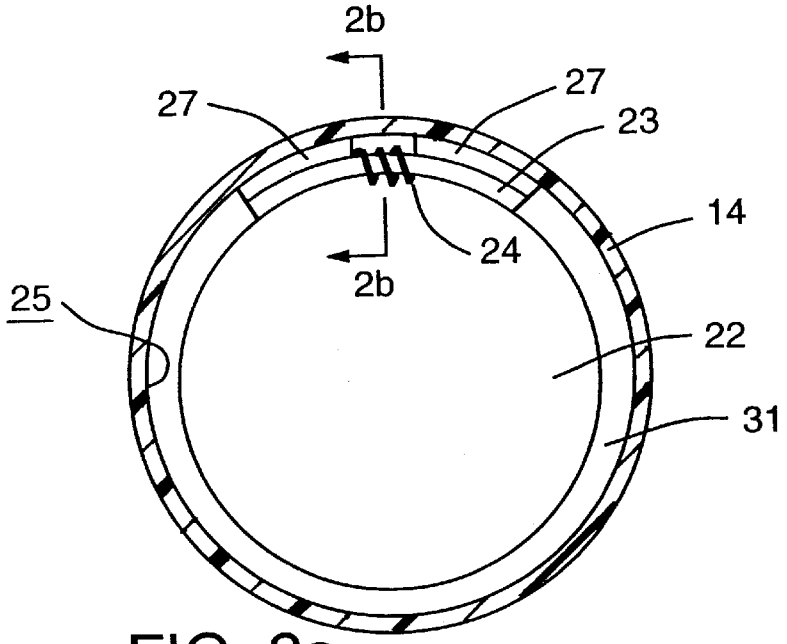
FIG. 2*a* is a sectional view taken along line 2*a*–2*a* of FIG. 2.
Figure 2B:
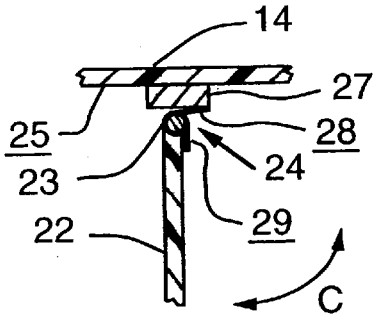
FIG. 2*b* is a sectional view taken along line 2*b*–2*b* of FIG. 2*a*.

As shown in FIGS. 2, 2*a* and 2*b*, the valve assembly 20 may include, for example, a valve element 22, a hinge pin 23, a support plate 27, and a spring 24, such as a torsion spring or a coil spring, for biasing the valve element 22. The spring 24 may include a first end 28 in contact with support plate 27 and a second end 29 in contact with valve element 22 so as to provide for the biasing of the valve element 22. The valve assembly 20 may be secured to an inner wall 25 of valve element by any conventional means, such as, a bonding adhesive or a mechanical fastener or other suitable means.

The valve assembly 20 allows for the valve element 22 to be biased or maintained in a closed position during non-use of the urinal 10 (as shown in solid line in FIG. 2) and allows for the valve element 22 to open during use of the urinal 10 (as shown in phantom line in FIG. 2). Rotation of the valve element 22 is as indicated by arrow C. The valve element 22 is rotated to the open position either by physical contact with the user's penis or by pressure or force exerted by the stream of urine.

When the valve element 22 is in the closed position, the spout 14 is sealed as a result of engagement between a sealing ledge 31, located on the perimeter of the valve element 22 and the inner wall 25 of the spout 14. The sealing ledge 31 may be formed of a flexible material that provides for effective sealing of spout 14 and flexible engagement therebetween during movement or rotation of valve element 22. Preferably, the spout 14 is generally symmetrical along a longitudinal axis of the spout 14. In order to effectively provide for the sealing engagement between the sealing ledge 31 of valve element 22 and the inner wall 25 and resist backflow or spillage of the urine from the reservoir 12, the valve element 22 and the sealing ledge 31 are also generally symmetrical along a longitudinal axis of spout 14 Valve element 22 is shaped, for example, such that when it contacts the bottom of inner wall 25 it prevents valve element 22 from rotating towards the inlet 16.

When the valve element 22 is rotated to the open position (shown in phantom line in FIG. 2), urine is allowed to freely flow therethrough under the influence of gravity and into the reservoir 12. The valve element 22, as described, is opened by either physical contact with the penis or pressure exerted on the valve element 22 by the stream of urine. The hinge pin 23 provides a pivot axis about which the valve element 22 rotates.

In accordance with an important aspect of the present invention, the valve assembly 20, as described herein, provides for the automatic opening and closure of the valve element 22. Advantageously, this allows for urine to be easily delivered into the reservoir 12, as well as, automatically resists backflow and spillage following use of the urinal 10.

As shown in FIGS. 1 and 2, the valve assembly 20 may be positioned adjacent the inlet 16. Alternatively, the valve assembly 20 may be positioned at various points along the length of the spout 14. Depending upon the placement of the valve assembly along the length of spout 14, either the physical contact from the penis or the pressure exerted by a stream of urine may act to move the valve element 22.

Other means such as an operating rod (not shown) connected to the valve element 22 and extending out of the spout inlet 16 may be employed to also move or rotate valve element 22.

The reservoir 12 and spout 14 of the urinal 10 may be formed from a resinous plastic material in order to provide for a substantially rigid urinal. Preferably, the resinous plastic material is transparent in order to provide for visual inspection of the amount of urine and clarity and color of the urine contained within reservoir 12.

The reservoir 12 portion of the urinal 10 may include a drain assembly 26 in order to provide for drainage of the urine from the reservoir. The drain assembly 26 may include an outlet 33 formed in the reservoir 12 portion of urinal 10 and cooperating resilient plug 35 which is slidably insertable and removable therewith, as indicated by arrow D. Drain assembly 26 would also allow for a specimen of urine to be withdrawn from the reservoir 12 for testing. Once the reservoir 12 becomes filled with urine, then the entire urinal 10 may be disposed of following drainage and disposal of the urine. Of course, the urinal may be formed of other appropriate materials, such as glass particularly where the urinal is not to be disposable but rather cleaned and reused.

Figure 3:
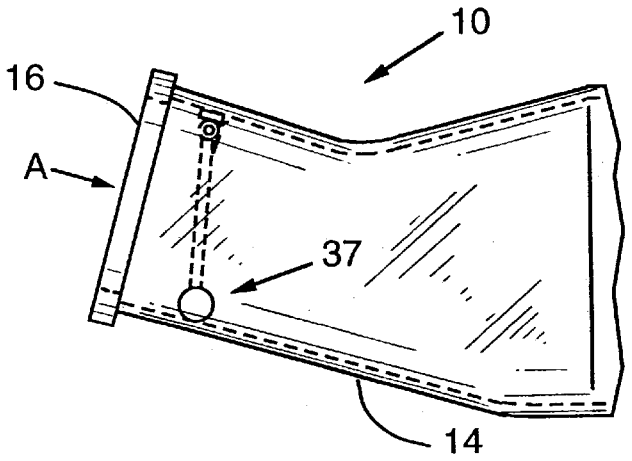
FIG. 3 is a further embodiment showing the -portable male urinal of FIG. 1 as having a check valve assembly.

FIG. 3 shows another type of valve arrangement which may be employed with the present invention in order to resist the backflow of urine. Specifically, a check valve assembly 37 is illustrated for resisting the backflow of urine.

Figure 4A:
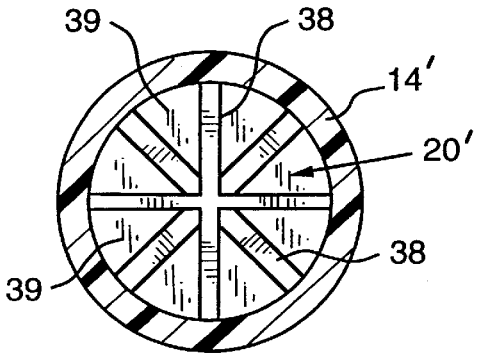
FIG. 4*a* is a sectional view taken along the line 4*a*–4*a* of FIG. 4.
Figure 4B:
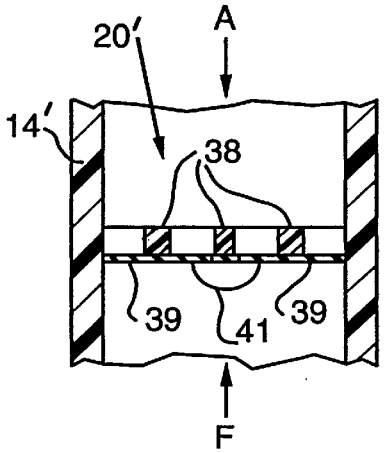
FIG. 4*b* is a sectional view taken along the line 4*b*–4*b* of FIG. 4.
Figure 4:
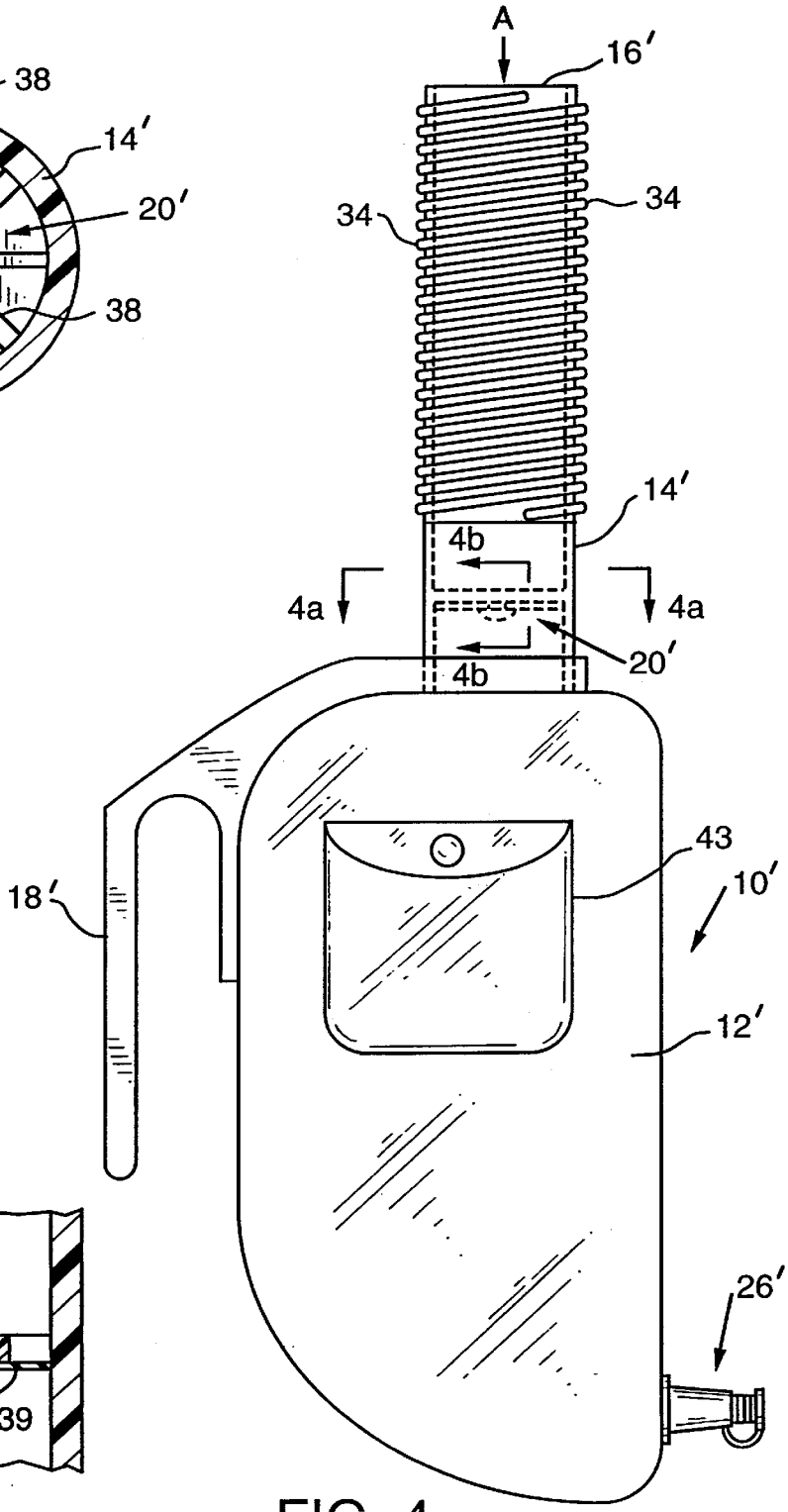
FIG. 4 is a further embodiment showing a portable male urinal of the present invention.

FIG. 4 shows a further embodiment of another urinal 10' of the present invention. Similar to the preferred embodiment, urinal 10' may include a urine-receiving reservoir 12' for receiving and storing urine and a spout 14' extending therefrom wherein the spout 14' includes an inlet 16' for receiving the urine in the direction indicated by arrow A. In this embodiment, the spout 14' is preferably formed of a bendable resilient material and includes flexible ridges 34 which allow for the spout 14' to be positioned at various angles in order to better accommodate use of the urinal 10' based upon the user's particular needs. For example, portable male urinals are often used by bedridden patients which makes it more difficult for the patient to use the urinal. By providing for spout 14' to be formed of a bendable resilient material having the flexible ridges 34, the patient may position the spout at various angles depending upon a particular patient's or user's mobility and individual needs. The flexible ridges 34 may be formed on the exterior and/or interior of the spout 14', but preferably are formed on the exterior with the interior remaining smooth so that the flow of the urine into the urinal 10' is not disrupted. In this embodiment, the valve assembly 20' is preferably formed at a lower end of the spout 14' to prevent the flexible ridges 34 from interfering with the operation of the valve assembly 20'.

Referring to FIGS. 4, 4*a* and 4*b*, the valve assembly 20' is illustrated. In this embodiment, the valve assembly 20' includes a support member, such as spokes 38 extending transversely across the spout 14' and a moveable valve element, such as flexible leaf member 39, attached to the spokes 38 and movable with respect thereto. Preferably, the flexible leaf member 39 is attached to the spokes 38 at the center point thereof by fastener 41 (FIG. 4*b*) or other suitable means. The fastener 41 secures the flexible leaf member 39 to the spokes 38 in the area adjacent the fastener, but leaves the outer edges of the flexible leaf member 39 free to move with respect to the spokes 38. Accordingly, when urine enters the spout 14' in the direction indicated by arrow A, the urine flows freely past the spokes 38 and exerts a pressure upon the flexible leaf member 39. The pressure exerted by the urine upon the flexible leaf member 39 causes the outer edges, i.e. the portion of the flexible leaf member 39 not secured directly to the spokes 38 by the fastener 41, of the flexible leaf member 39 to move away from the spokes 38 and allow the urine to flow through the spout 14' and into the urine-receiving reservoir 12'.

Once the urine is received in the urine-receiving reservoir 12', the flexible leaf member 39 prevents the urine from flowing out of the urine-receiving reservoir 12' and back through the spout 14'. This is accomplished by urine, flowing in the direction indicated by arrow F, exerting a pressure on the surface area of the flexible leaf member 39. The pressure exerted by the urine in the direction of arrow F effectively seals the flexible leaf member 39 against the spokes 38. Accordingly, this prevents backflow of the urine and resists spillage of urine from the urine-receiving reservoir 12'.

In a similar embodiment (not shown) employing a similar concept as set forth in FIGS. 4*a* and 4*b*, the moveable valve element may be a rigid sliding member that moves with respect to the support member in response to urine flow in one direction and is sealed firmly against the support member in response to urine flow in an opposite direction. Of course, the support member would need to be other than the described spokes configuration to accommodate the rigid sliding member. For example, the support member may be a circular disc mounted to the walls of the spout and having one or more holes therein that allow urine to flow therethrough and contact the rigid sliding member and move the same allowing urine to flow into the urinal.

The flexible leaf member 39 is preferably formed of a material suitable for sealingly engaging the spokes 38 to resist the backflow of urine. In addition, the material for forming the flexible leaf member 39 must be sufficiently resilient so as to allow for the flow of urine to move the flexible leaf member 38 away from spokes 39 to allow the urine to flow therethrough. Preferably, the flexible leaf member is formed of a material, such as, for example, latex or silicon.

In the embodiment set forth in FIG. 4, the urinal 10' also includes a handle 18' and a drain plug 26'. The urinal 10' may also include a compartment 43 for storing, such as, for example, wipettes for use by a user of the urinal 10'.

In the embodiment set forth in FIG. 4, the urine-receiving reservoir 12' is preferably formed of a flexible material. This allows for the urinal 10' to be more easily handled in comparison to the rigid construction of conventional male urinals. The material for forming the urine-receiving reservoir 12' may be any material, such as a plastic or similar material, as is suitable for providing a flexible urine-receiving reservoir 12'. Preferably, the material is transparent in order to provide for visual inspection of the amount of urine and clarity and color of the urine contained within reservoir 12'.

In addition, the spout 14' and urine-receiving reservoir 12' are preferably integrally formed so as to provide a urinal 10' consisting of a single piece construction. Preferably, the urinal 10' is formed of a low-cost material so as to provide for a disposable urinal which may be used and then properly discarded in conformance with proper health and safety standards. By providing for a low cost urinal that may be disposed of following use, health care workers are not unnecessarily exposed to previously used urinals that must be cleaned and sanitized prior to reuse.

Figure 5:
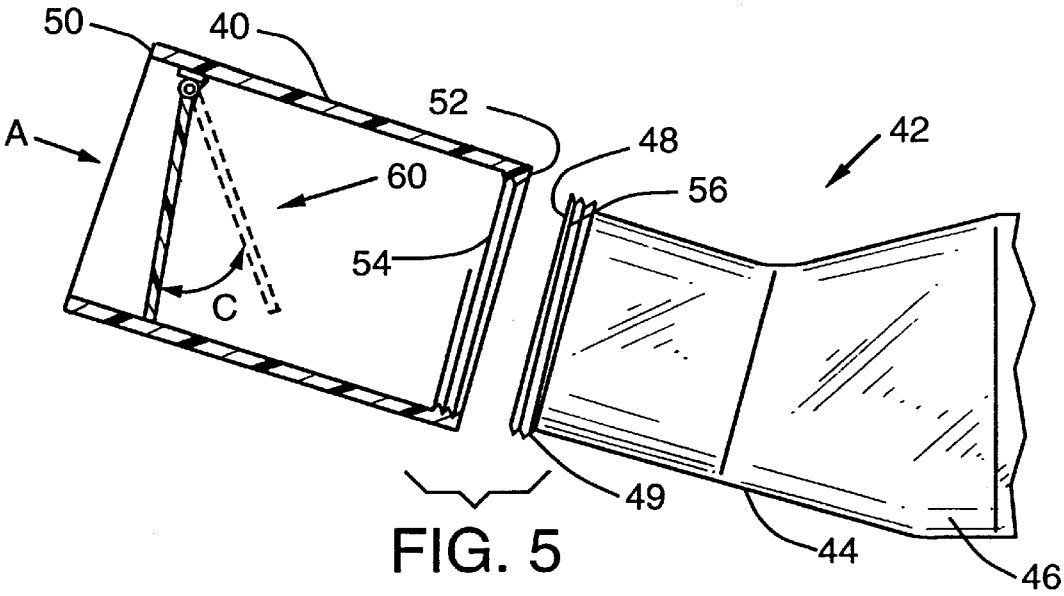
FIG. 5 is a further embodiment showing a sectional view of a urinal attachment which may be threadedly connected to a conventional portable male urinal.
Figure 5A:
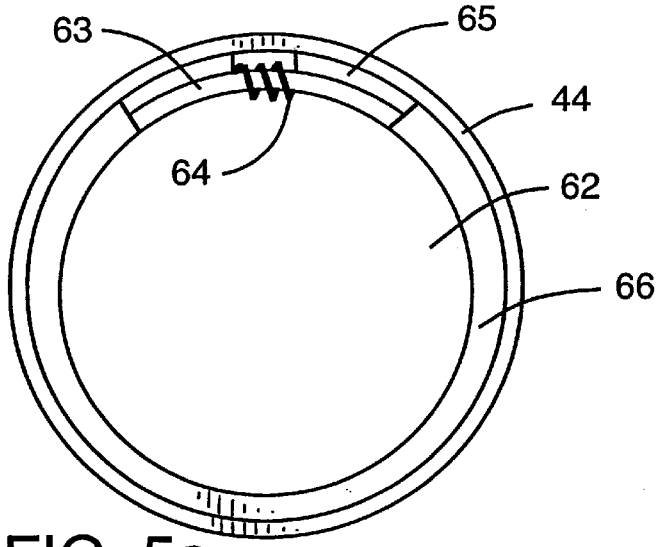
FIG. 5*a* is side view of the urinal attachment shown in FIG. 5.
Figure 6:
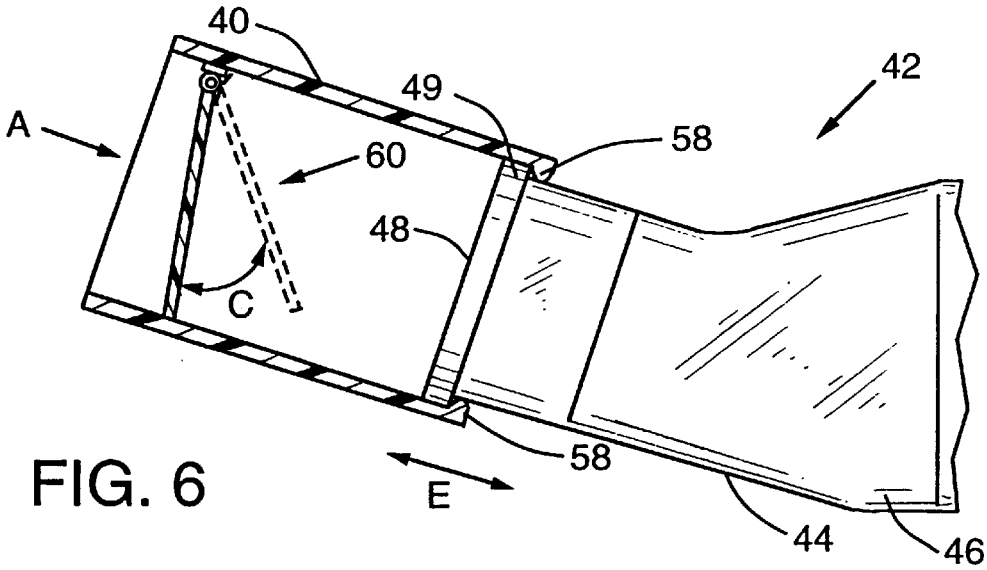
FIG. 6 is a further embodiment showing a sectional view of a urinal attachment which is secured to a conventional portable male urinal by friction fit.
Figure 7:
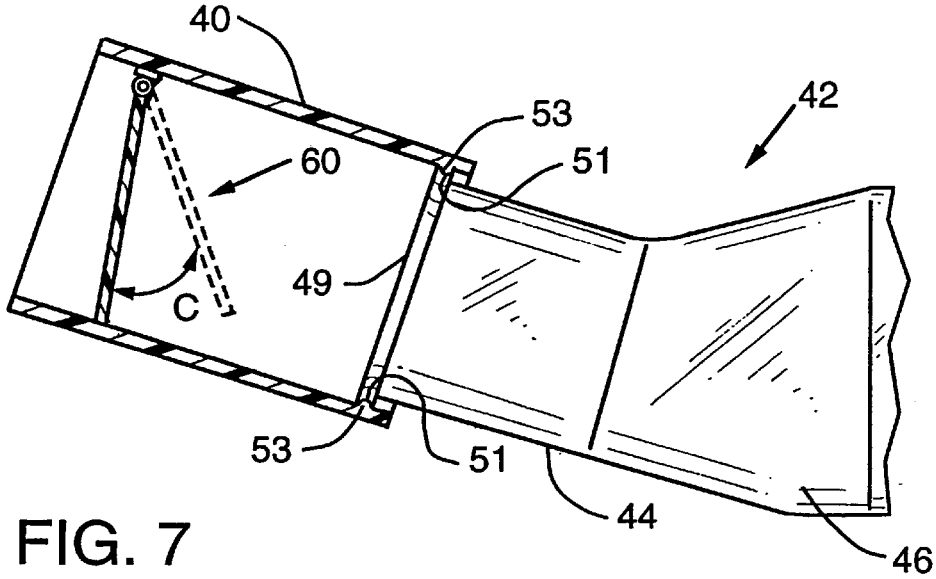
FIG. 7 is a further embodiment showing a sectional view of a urinal attachment which is secured to a conventional portable male urinal by snap fit.

With reference to FIG. 5 and 5*a*, there is shown a further embodiment of the present invention which permits use with a known male urinal. It includes a portable male urinal assembly having a urinal attachment 40 and a conventional portable male urinal 42, which is similar to the urinal 10 described herein except that a valve assembly is not provided in the spout 44 of the conventional urinal 42. The conventional urinal 42 otherwise includes a urine receiving reservoir 46 and an inlet 48 at the end of the spout 44 for receiving the urine. The urinal attachment 40 includes a first end 50 for receiving the urine and a second end 52 which may be secured in fluid communication to the upper end 49 of the spout 44. As shown in FIG. 5, the urinal attachment 40 may be threadedly secured to the upper end 49 by mating threads 54, 56 which are provided on the second end 52 of the urinal attachment 40 and the upper end 49 of the spout 44, respectively. Alternatively, the urinal attachment 40 may be secured to the spout 44 by friction fit as shown in FIG. 6 or by snap fit as shown in FIG. 7. In FIG. 6, the urinal attachment 40 includes projections 58 which may be slidably inserted over the upper end 49 of spout 44 and then slidably removed following use, as indicated by directional arrow E. In FIG. 7, urinal attachment 40 includes extensions 53 for snapping into channel 51 formed around upper end 49 of spout 44.

As shown in FIGS. 5, 6, and 7, the urinal attachment 40 includes a valve assembly 60 for permitting the flow of urine into the reservoir 46 while resisting backflow or spillage of the urine following use of the urinal 42. The valve assembly 60 may be similar to the valve assembly 20 as described above and include a valve element 62, a hinge pin 63, a spring 64, a support plate 65 and a sealing ledge 66. As should be appreciated, other types of valve arrangements, as described herein, may also be used with the urinal attachment 40.

The valve assembly 60 may be positioned adjacent the first end 50 of the urinal attachment 40, or the valve assembly 60 may be positioned at various points along the length of the urinal attachment 40. In order to provide for a close fit between the upper end 49 of the spout 44 and the urinal attachment 40, the urinal attachment 40 is generally symmetrical along a longitudinal axis extending the length of the urinal attachment 40 and generally circular in cross section, similar to the spout 44.

The use of a urinal attachment 40 allows for the concept of the present invention to be utilized with a conventional portable male urinal 42. The urinal attachment 40 can easily be secured to the inlet 48 of the spout 44, either by threaded engagement, snap fit or friction fit as described above, and can be easily removed and disposed of, if desired.

It will be appreciated that the present invention provides for an improved portable male urinal having a valve assembly contained in the spout portion of the urinal which permits urine to flow into the urinal, but resists backflow of the urine following use of the urinal. It will be further appreciated that the present invention provides for a urinal attachment having a similar valve assembly contained therein for attaching to a conventional portable male urinal. Both the portable male urinal with valve assembly and urinal attachment with valve assembly effectively resist the backflow of urine and resist undesirable spillage of urine following use of the urinal.

Whereas particular embodiments of the present invention have been described herein for purposes of illustration, it will be evident to those skilled in the art that numerous variations of the details may be made without departing from the invention as defined in the appended claims.

What is claimed is:

1. A portable male urinal assembly comprising:

a urine receiving reservoir having a spout extending therefrom;

said spout having an inlet for receiving the urine;

a urinal attachment having a first end and a second end, the first end having an opening for receiving the urine, the second end being secured in fluid communication to the inlet of said spout;

a valve means contained within said urinal attachment for permitting flow of the urine into said reservoir, while resisting undesired flow of the urine out of said urinal from said reservoir, said spout inlet and said urinal attachments;

said valve means includes movable valve element attached to said urinal attachment and mounted for movement with respect thereto;

wherein said valve means includes a torsion spring biasing means; and wherein said valve element opens automatically to permit flow of the urine into said reservoir.

2. The portable male urinal assembly of claim 1 wherein the second end of said urinal attachment is secured to the inlet of said spout by friction fit.

3. The portable male urinal assembly of claim 1 wherein the second end of said urinal attachment is threadedly secured to the inlet of said spout.

4. The portable male urinal assembly of claim 1 wherein said valve means includes a check valve.

5. The portable male urinal assembly of claim 1 wherein said urinal attachment is composed of a bendable resilient material.

6. The portable male urinal assembly of claim 1 wherein said portable male urinal and said urinal attachment are formed from a resinous plastic material.

7. The portable male urinal assembly of claim 1 wherein the second end of said urinal attachment is secured to the inlet of said spout by snap fit.

* * * * *

UNITED STATES PATENT AND TRADEMARK OFFICE

CERTIFICATE OF CORRECTION

PATENT NO. : 6,163,892
DATED : December 26, 2000
INVENTOR(S) : Tomasine Abbato

It is certified that error appears in the above-identified patent and that said Letters Patent is hereby corrected as shown below:

Column 3,
Line 48, "-portable" should be -- portable --.

Column 4,
Line 10, a common -- , -- should be inserted after "reservoir 12".
Line 67, a period -- . -- should be inserted after "spout 14".

Column 6,
Line 62, "leaf member 38 away from spokes 39" should be -- leaf member 39 away from spokes 38 --.

Column 8,
Line 40, "attachments" should be -- attachment --.

Signed and Sealed this

Fourteenth Day of May, 2002

*Attest:*

*Attesting Officer*

JAMES E. ROGAN
*Director of the United States Patent and Trademark Office*